US009766044B2

(12) United States Patent
Vito et al.

(10) Patent No.: US 9,766,044 B2
(45) Date of Patent: Sep. 19, 2017

(54) PROTECTIVE SYSTEM FOR CARRYING EQUIPMENT

(71) Applicant: Matscitechno Licensing Company, Kennett Square, PA (US)

(72) Inventors: Robert A. Vito, Kennett Square, PA (US); Michael Foerster, Newtown Square, PA (US)

(73) Assignee: Matscitechno Licensing Company, Kennett Square, PA (US)

( * ) Notice: Subject to any disclaimer, the term of this patent is extended or adjusted under 35 U.S.C. 154(b) by 0 days.

(21) Appl. No.: 14/291,643

(22) Filed: May 30, 2014

(65) Prior Publication Data

US 2015/0272244 A1 Oct. 1, 2015

Related U.S. Application Data

(60) Provisional application No. 61/971,573, filed on Mar. 28, 2014.

(51) Int. Cl.
*F41H 1/02* (2006.01)
*A41D 13/05* (2006.01)

(52) U.S. Cl.
CPC ..... *F41H 1/02* (2013.01); *A41D 13/0518* (2013.01)

(58) Field of Classification Search
CPC ..... A41D 3/0016; A41D 13/0518; F41H 1/02
USPC ..... 2/463, 2.5, 464
See application file for complete search history.

(56) References Cited

U.S. PATENT DOCUMENTS 2,789,076 A * 4/1957 Frieder ..... B32B 27/00 2/2.5
3,945,042 A * 3/1976 Lobo ..... A41D 13/0156 2/16
4,272,847 A * 6/1981 Buhler ..... A63B 71/12 2/461
4,610,035 A * 9/1986 Mattila ..... A41D 13/0518 2/16
4,735,423 A * 4/1988 Foss ..... B62B 15/00 2/2.5
4,993,076 A * 2/1991 Dierickx ..... A41D 13/0158 2/2.5
5,113,526 A * 5/1992 Wang ..... A43B 7/32 2/10
5,245,706 A * 9/1993 Moschetti ..... A63B 71/12 2/2.5
5,652,967 A * 8/1997 Hsu ..... A41D 13/0158 2/455

(Continued)

OTHER PUBLICATIONS

International Search Report and Written Opinion issued in PCT/US2015/020076 dated Jun. 19, 2015.

(Continued)

*Primary Examiner* — Shaun R Hurley
*Assistant Examiner* — Bao-Thieu L Nguyen
(74) *Attorney, Agent, or Firm* — RatnerPrestia

(57) ABSTRACT

A protective system includes a garment configured to be worn by a user. The garment includes a padding layer having at least one layer of elastomeric material and at least one layer of high tensile strength fibrous material. The padding layer also includes a plurality of openings formed in a surface thereof. The system may further include one or more load bars. Each of the load bars would extend along the surface of the padding layer between respective ones of the plurality of openings.

14 Claims, 5 Drawing Sheets

(56) References Cited

U.S. PATENT DOCUMENTS 5,669,080 A * 9/1997 Culton ..... A63B 71/12 2/455
5,974,585 A * 11/1999 Bachner, Jr. ..... A41D 31/0061 2/2.5
5,978,961 A * 11/1999 Barker ..... A41D 13/015 2/2.5
6,375,537 B1 * 4/2002 Jankowski ..... A41C 3/0057 2/463
6,510,777 B2 1/2003 Neal
6,685,071 B2 * 2/2004 Prather ..... A45C 15/00 2/2.5
6,705,197 B1 * 3/2004 Neal ..... F41H 1/02 2/2.5
7,200,871 B1 * 4/2007 Carlson ..... A41D 13/0012 2/102
7,210,390 B1 * 5/2007 Olson ..... F41H 1/02 2/2.5
7,937,768 B2 * 5/2011 Behrend ..... A41D 13/0543 2/2.5
8,079,503 B1 * 12/2011 Yeates ..... A45C 7/0086 224/268
8,220,079 B2 * 7/2012 Syska ..... A61M 39/0208 2/463
8,584,917 B2 * 11/2013 Hexels ..... A45F 3/08 2/102
8,739,312 B1 * 6/2014 Brown ..... F41H 1/02 2/2.5
2005/0015943 A1 * 1/2005 Wemmer ..... A41D 13/0012 24/580.1
2005/0108800 A1 * 5/2005 White ..... A41D 13/0153 2/2.5
2006/0005306 A1 * 1/2006 Call ..... A41D 13/0518 2/463
2007/0079416 A1 * 4/2007 Carlson ..... A41D 13/0012 2/2.5
2007/0289045 A1 12/2007 Evans et al.
2008/0010730 A1 * 1/2008 Twito ..... A45F 3/06 2/463
2008/0178371 A1 * 7/2008 Landi ..... A41D 13/0518 2/463
2008/0289087 A1 * 11/2008 Sundnes ..... A41D 31/0061 2/456
2009/0282595 A1 11/2009 Branson et al.
2010/0050327 A1 * 3/2010 Kataoka ..... A41D 13/0518 2/463
2010/0095441 A1 * 4/2010 Wingo ..... A63B 71/12 2/462
2011/0035855 A1 * 2/2011 Gewant ..... F41H 1/02 2/2.5
2012/0034833 A1 2/2012 Schaube et al.
2012/0084906 A1 * 4/2012 Sego, Jr. ..... F41H 1/02 2/463
2012/0174280 A1 * 7/2012 Strum ..... F41H 1/02 2/69
2012/0175390 A1 7/2012 Rogers et al.
2012/0246788 A1 * 10/2012 Harrell ..... A41D 31/005 2/2.5
2013/0149103 A1 * 6/2013 Stevenson ..... F41H 5/04 415/9
2013/0276218 A1 * 10/2013 Parisi, Jr. ..... F41H 1/02 2/463
2014/0289938 A1 * 10/2014 Brown ..... A41D 13/015 2/455
2014/0332572 A1 * 11/2014 Buerck ..... F41H 1/02 223/111
2015/0082524 A1 * 3/2015 Ben David ..... A45F 3/04 2/463

OTHER PUBLICATIONS

International Preliminary Report on Patentability and Written Opinion dated Oct. 4, 2016 for International Application No. PCT/US2015/020076; 8 pages.

* cited by examiner

PROTECTIVE SYSTEM FOR CARRYING EQUIPMENT

CROSS-REFERENCE TO RELATED APPLICATIONS

This application claims priority to U.S. patent application Ser. No. 61/971,573, entitled "PROTECTIVE SYSTEM FOR CARRYING EQUIPMENT," filed Mar. 28, 2014, the contents of which are incorporated herein by reference in their entirety.

FIELD OF THE INVENTION

The invention relates generally to the field of protective materials, and more particularly, to impact-resistant protective materials configured for carrying equipment.

BACKGROUND OF THE INVENTION

Conventionally, members of the armed forces are required to carry substantial amounts of equipment as part of their regular duties and/or excursions. This equipment may be numerous, burdensome, and in some cases delicate. Accordingly, various systems have been developed for assisting members of the military (and other persons engaged in such tasks) in carrying equipment. One such system is the Modular Lightweight Load-carrying Equipment, or MOLLE. The MOLLE System is utilized by a number of armed forces (including North Atlantic Treaty Organization (NATO) armed forces) for assisting with carrying load-bearing equipment. The MOLLE System generally includes attachment points which enable a user to attach the equipment being carried directly to the MOLLE, enabling the user to have their hands free while transporting the equipment.

The same groups of people requiring such systems for carrying equipment may also find the need to protect themselves from dangerous impacts that arise during the course of their duties. In particular, a member of the armed forces may occasionally be in danger from high force impacts from bullets, shrapnel, or other weapons. The danger from these weapons can be diminished or minimized by effectively protecting people from the forces of these impacts. Accordingly, improved structures are desired to lessen the impact forces experienced by those users, without sacrificing the ability of those users to perform their day-to-day tasks, such as transporting equipment.

SUMMARY OF THE INVENTION

Aspects of the invention are directed to systems for carrying equipment. In accordance with one aspect of the present invention, a protective system includes a garment configured to be worn by a user. The garment includes a padding layer having at least one layer of elastomeric material and at least one layer of high tensile strength fibrous material. The padding layer also includes a plurality of openings formed in a surface thereof. The system may further include one or more load bars. Each of the load bars would extend along the surface of the padding layer between respective ones of the plurality of openings.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. According to common practice, the various features of the drawings are not drawn to scale unless otherwise indicated. To the contrary, the dimensions of the various features may be expanded or reduced for clarity. Included in the drawings are the following figures.

DETAILED DESCRIPTION OF THE INVENTION

The embodiments of the invention described herein relate to protective systems configured for assisting the user in carrying equipment. The exemplary protective systems described herein incorporate impact-resistant materials to cushion the force of impacts to the user's body. As used herein, the term "impact-resistant" is intended to encompass any object that partially or fully lessens, diminishes, dissipates, deflects, or absorbs the mechanical force of an impact.

The exemplary protective systems disclosed herein are particularly suitable for use by members of the armed forces and/or military whose regular duties include carrying substantial amounts of equipment, and who may in the line of duty be exposed to high-force impacts (for example, from bullets, shrapnel, explosions, or other dangerous devices). Nonetheless, while the exemplary embodiments of the invention are described herein with respect to the military, it will be understood that the invention is not so limited. Suitable applications for the protective systems of the present invention also include construction or athletic fields. Other suitable applications will be readily understood by one of ordinary skill in the art from the description herein.

Figure 1A:
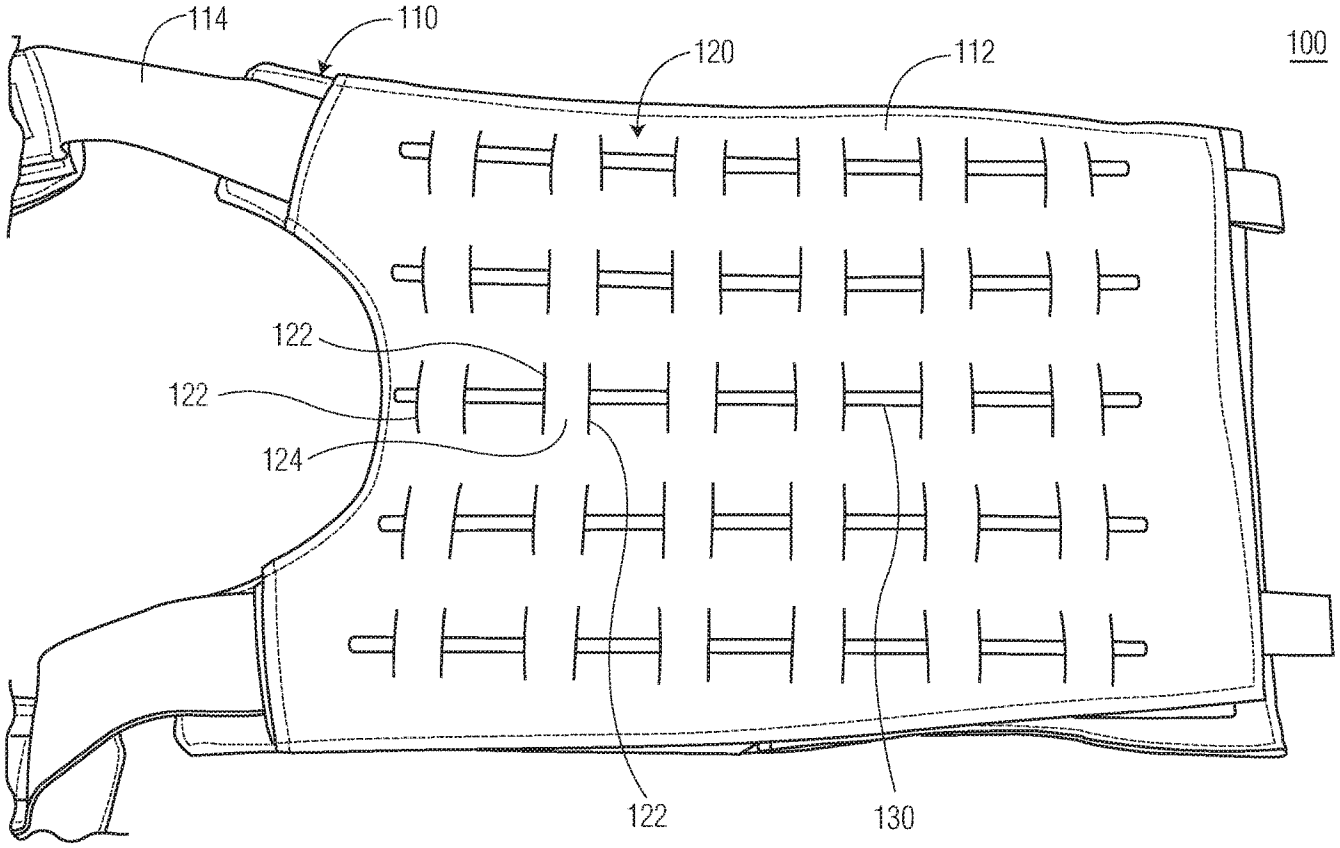
FIG. 1A is an image illustrating an exemplary protective system for carrying equipment in accordance with aspects of the present invention.

Referring now to the drawings, FIG. 1A illustrates an exemplary protective system 100 in accordance with aspects of the present invention. System 100 may be worn by a member of the armed forces. As a general overview, system 100 includes a garment 110 and optionally includes at least one load bar 130. Additional details of system 100 are described herein.

Garment 110 is worn by the user of system 100. Garment 110 may be shaped like a conventional article of clothing, or may be simply be attached to an article of clothing. Garment 110 may be attached to an article of clothing, for example, via hook and loop fasteners, stitching, pockets, zippers, snaps, buckles, or other conventional fastening means. Suitable objects for attaching garment 110 to an article of clothing will be known to one of ordinary skill in the art.

In an exemplary embodiment, garment 110 is shaped like a vest, as shown in FIG. 1A. In this embodiment, garment 110 can be worn over the user's torso in conventional fashion. As shown in FIG. 1A, garment 110 includes a front protector 112 sized to protect the front of the user's torso, and a pair of straps 114 positioned to extend over the user's shoulders.

Figure 1B:
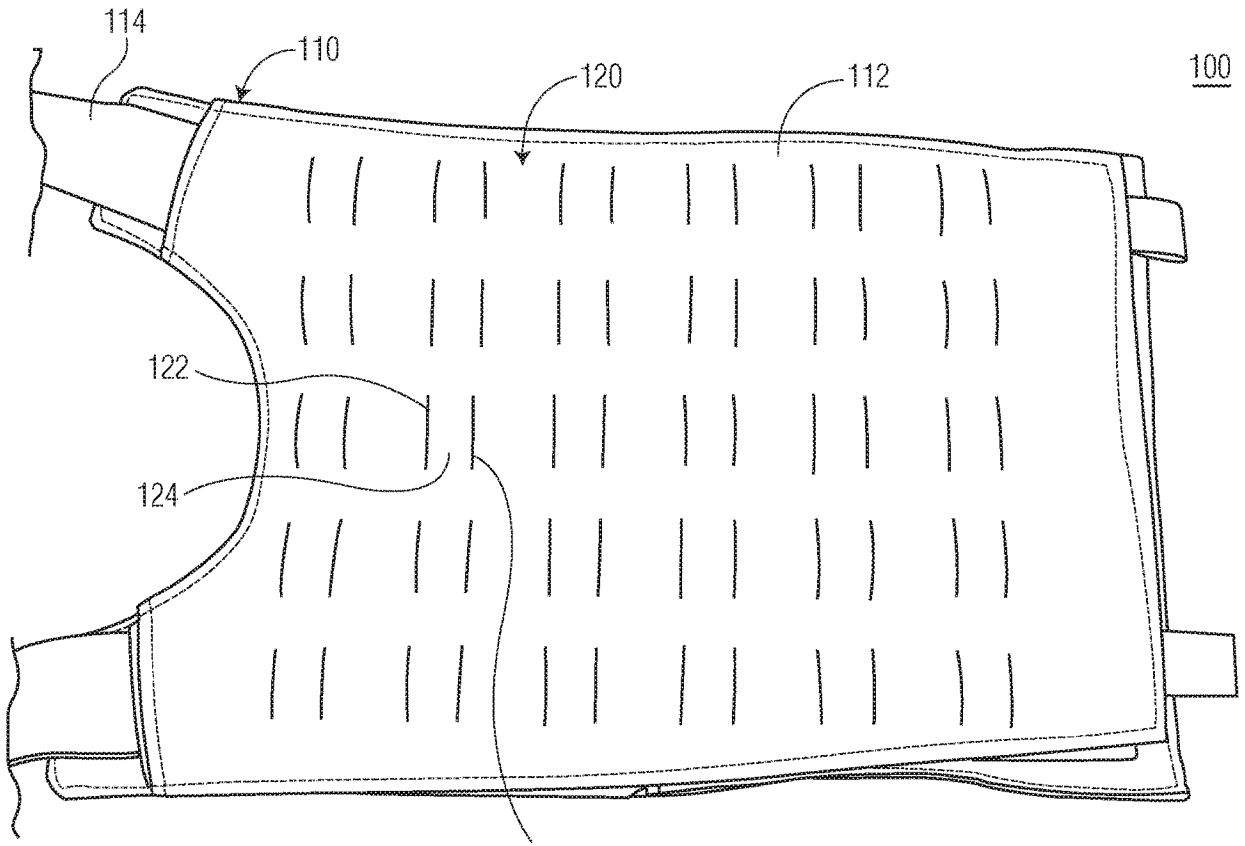
FIG. 1B is an image illustrating the protective system of FIG. 1A with the load bars removed.

Garment 110 includes a padding layer 120. In an exemplary embodiment, padding layer 120 forms the front protector 112 of garment 110, as shown in FIGS. 1A and 1B. However, the size and shape of padding layer 120 shown in the figures is not intended to be limiting. To the contrary, the shape and size of padding layer 120 may be selected to provide the desired level of protection to the user of system 100.

Padding layer 120 is formed from impact-resistant materials. For example, padding layer 120 may include a layer of elastomeric material. The elastomeric material may provide impact-resistance by absorbing and dissipating the force of impacts laterally along the surface of the elastomeric material. In one exemplary embodiment, padding layer 120 comprises only a single layer of elastomeric material. In another exemplary embodiment, padding layer 120 comprises two or more layers of elastomeric material. Padding layer 120 may include the layers of elastomeric material directly adjacent each other, or in a more preferred embodiment, may include a layer of high tensile strength fibrous material between the layers of elastomeric material.

Suitable materials for forming the elastomeric layer(s) include, but are not limited to, urethane rubbers, silicone rubbers, nitrile rubbers, butyl rubbers, acrylic rubbers, natural rubbers, styrene-butadiene rubbers, and the like. In general, any suitable elastomer material can be used to form the above-described elastomeric layers without departing from the scope of the present invention. Suitable materials for forming the layer of high tensile strength fibrous material include, but are not limited to, aramid fibers, fiberglass, or other high tensile strength fibers. The fibers may be woven to form a cloth layer that is disposed between and generally separates the opposing elastomeric layers. The high tensile strength fibrous material layer may desirably block and redirect impact energy that passes through one of the elastomeric layers. Additional description of materials for forming padding layer 120 may be found in U.S. patent application Ser. No. 09/978,130, the contents of which are incorporated herein by reference in their entirety for all purposes.

The materials and thickness of padding layer 120 can be selected such that padding layer 120 remains sufficiently flexible to conform to the periphery of the user's body or torso. Additionally, the order of materials in padding layer 120 may be important for providing optimal protection to the user. In an exemplary embodiment in which padding layer 120 includes a layer of elastomeric material and a layer of high-tensile strength fibrous material, the layer of high-tensile strength fibrous material is positioned closer to the user than the layer of elastomeric material. This may desirably protect the layer of high-tensile strength fibrous material from rips, tears, or punctures, as it may be more susceptible to such damage than the layer of elastomeric material.

Padding layer 120 includes a plurality of openings 122 formed therein. Openings 122 may extend all the way through padding layer 120 or may extend only partially through padding layer 120. In the embodiment shown in FIGS. 1A and 1B, openings 122 are generally formed such that they extend in a line across the surface of padding layer 120. Each of the openings 122 in the line open in substantially the same direction along the line (i.e., left-right in FIG. 1A).

In an exemplary embodiment, openings 122 are formed by cutting slots in padding layer 120. Slots may be formed, for example, by cutting padding layer 120 with a laser (such as a conventional industrial laser) or by dye-cutting padding layer 120. Alternatively, openings 122 may be formed by cutting holes or gaps in padding layer 120, i.e., cutting material out of padding layer 120. The cut-out material may then be removed from padding layer 120 and discarded.

Figure 2A:
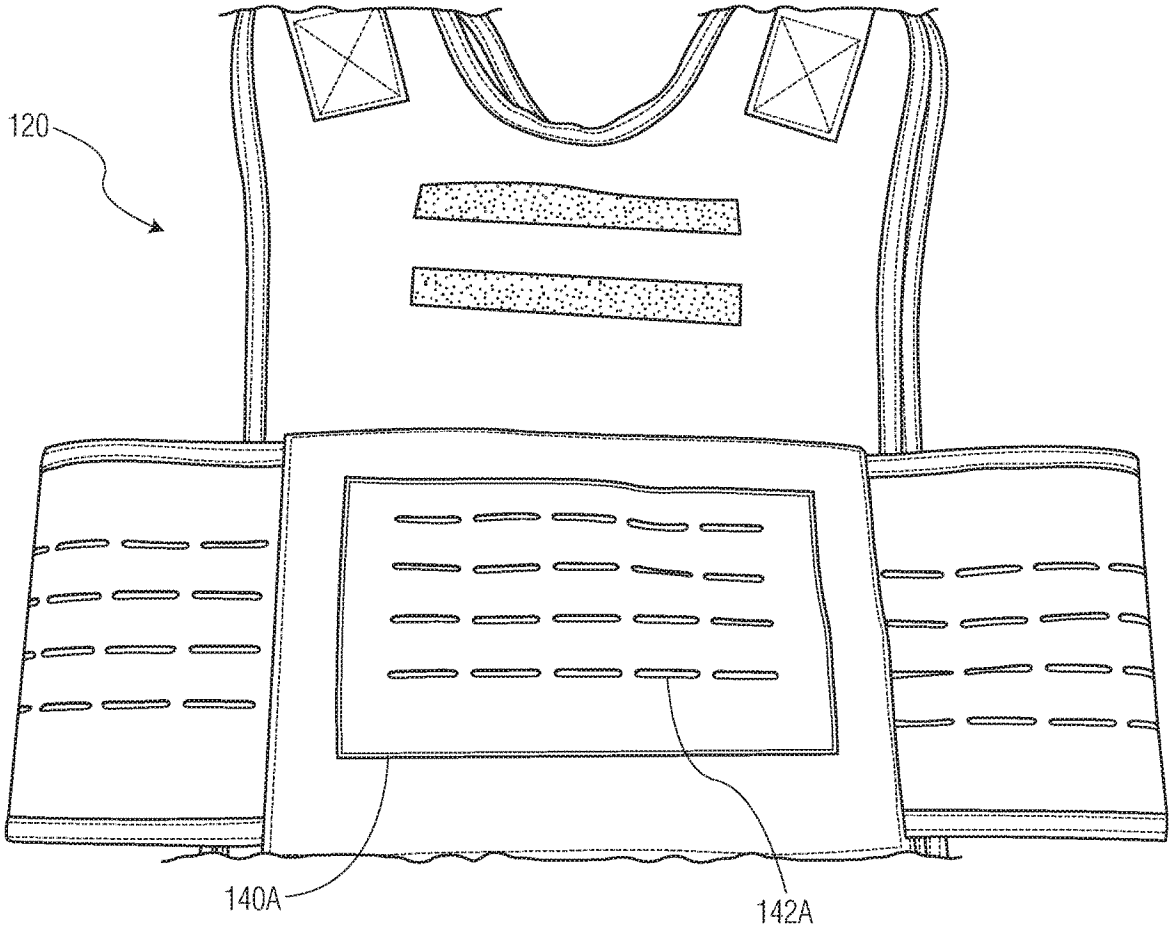
FIGS. 2A and 2B are images illustrating exemplary patterns for forming openings in the protective system of FIG. 1A.
Figure 2B:
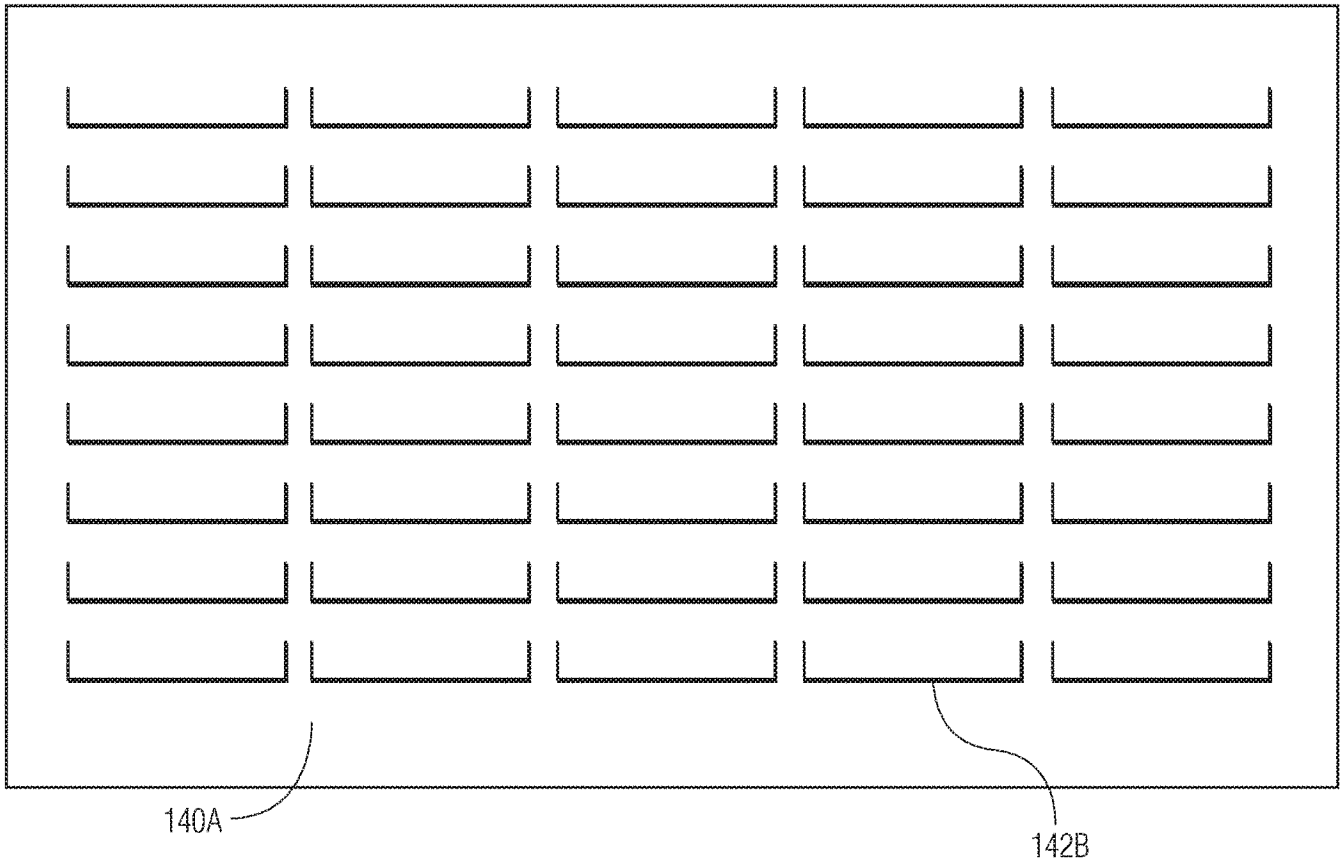

FIGS. 2A and 2B show exemplary patterns for laser-cutting openings 122 into padding layer 120. FIG. 2A shows an exemplary pattern 140*a* in which openings 122 are formed in a plurality of segmented lines across a surface of padding layer 120. Openings 122 formed using pattern 140*a* may be slots (e.g., by cutting along the center of the holes 142*a* in the pattern) or may be holes (e.g., by cutting along the edges of each hole 142*a* in the pattern).

FIG. 2B shows another exemplary pattern 140*b* in which openings 122 are formed by flaps cut in padding layer 120. The flaps may be formed by cutting three connected slots 142*b* in padding layer 120, such that a portion of padding layer 120 may be folded back to expose an opening 122. Openings 122 formed using this pattern may be particularly desirable because of the increased protection they provide. When openings using this pattern are unused, the flaps can be folded back into place such that no open area is formed in padding layer 120. The flaps need only be folded back from padding layer 120 when the corresponding opening 122 is in use.

With respect to the embodiment shown in FIGS. 1A and 1B, the opening 122 may be made in pairs, such that a pair of slots creates a strip 124 of padding layer 120 that extends between each opening. This embodiment may be desirably in order to avoid the need to add additional components to padding layer 120 in order to create openings 122.

As set forth above, system 100 may also include one or more load bars 130. Load bars 130 extend along the outer surface of padding layer 120 between openings 122. Where openings 122 extend all of the way through padding layer 120, load bars 130 may extend through one opening 122, beneath the surface of padding layer 120, and then out through an adjacent opening 122, as shown in FIG. 1A.

In an exemplary embodiment, load bars 130 may extend through a line of openings 122 in padding layer 120. As shown in FIG. 1A, for example, a single load bar 130 extends through twelve openings 122. Where openings 122 form strips 124, the load bar passes beneath each strip 124, and otherwise extends along the external surface of padding layer 120. Similarly with respect to the patterns shown in FIGS. 2A and 2B, load bars 130 may be inserted through lines of openings 122 (i.e., in the up-down direction of patterns 140A and 140B) in the same manner as illustrated in FIG. 1A.

Load bars 130 are formed from a material that is substantially more rigid than the material of padding layer 120. In an exemplary embodiment, load bars 130 may be formed, for example, from plastic, metal, wood, or other materials that would be known to one of ordinary skill in the art from the description herein.

In operation, a user of system 100 may have a number of pieces of equipment for carrying. This conventional equipment is generally configured to attached to a loop or strap on a conventional carrying apparatus. In accordance with aspects of the present invention, the equipment can instead be attached to the portions of load bars 130 extending along the front of padding layer 120. For example, one piece of equipment could be hooked or looped (e.g., using a carabiner) over each visible section of load bars 130, securing the equipment to system 100 and enabling the user to carry the equipment while keeping their arms and hands free. At the same time, padding layer 120 will provide impact-resistance to the user's torso.

Figure 3:
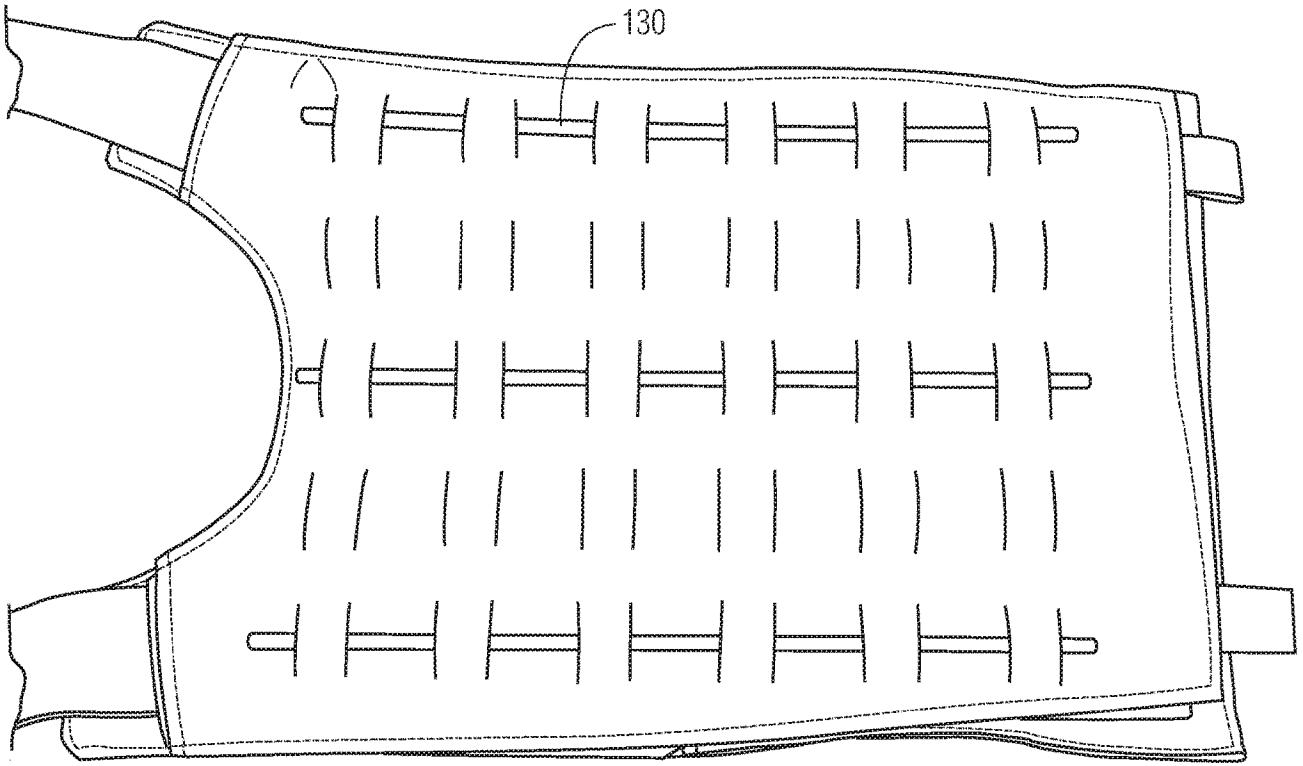
FIG. 3 is an image illustrating an alternative exemplary embodiment of the protective system of FIG. 1A.

The number and spacing of load bars 130 in FIG. 1A is shown for the purposes of illustration, and is not intended to be limiting. For example, while load bars 130 are shown as being arranged in parallel along padding layer 120, one of ordinary skill in the art will understand that other configurations may be selected based on the positioning of openings 122. Additionally, while five load bars 130 are shown in FIG. 1A, any number may be selected based on the desired equipment-carrying capacity of system 100. For example, a system including only three load bars 130 may optionally be used, as shown in FIG. 3.

In a preferred embodiment, load bars 130 are removably positioned within openings 122. In other words, when load bars 130 are not in use; a user may withdraw load bars 130 from openings 122, e.g., by sliding them out of the openings. This desirably allows padding layer 120 to lie flat against the torso of the user, increasing comfort and protection of the user, as shown in FIG. 1B. When the user once again desires to utilize load bars 130 to carry equipment, they may be re-inserted into openings 122. Following insertion, load bars 130 may be releasably secured within openings 122. Suitable structures for securing load bars 130 within openings 122 will be known to one of ordinary skill in the art from the description herein.

Alternatively, when load bars 130 are not used, the equipment can instead be attached directly through the openings 122 of padding layer 120. For example, one piece of equipment could be hooked or looped (e.g., using a carabiner) through a pair of adjacent openings 122, with a portion beneath padding layer 120, in order to secure the equipment to system 100 and enabling the user to carry the equipment while keeping their arms and hands free.

Although the invention is illustrated and described herein with reference to specific embodiments, the invention is not intended to be limited to the details shown. Rather, various modifications may be made in the details within the scope and range of equivalents of the claims and without departing from the invention. In particular, any of the features described herein with respect to one embodiment may be provided in any of the other embodiments.

What is claimed:

1. A protective system comprising:

a garment configured to be worn by a user, the garment including a padding layer comprising at least one layer of elastomeric material and at least one layer of high tensile strength fibrous material, the padding layer including a plurality of openings formed in a surface thereof, the openings extending from a front surface to a rear surface of the padding layer through the at least one layer of elastomeric material and the at least one layer of high tensile strength fibrous material; and a plurality of load bars, each of the load bars extending along the surface of the padding layer through respective ones of the plurality of openings to have alternating and repeating sections above the front surface of the padding layer and beneath the rear surface of the padding layer.

2. The protective system of claim 1, wherein the garment is a vest configured to be worn over the torso of the user.

3. The protective system of claim 2, wherein the vest comprises a front torso protector formed by the padding layer.

4. The protective system of claim 1, wherein the at least one layer of high tensile strength fibrous material has opposed major surface, and the at least one layer of elastomeric material comprises a layer of elastomeric material positioned directly adjacent each of the opposed major surfaces.

5. The protective system of claim 1, wherein the high tensile strength fibrous material comprises an aramid material.

6. The protective system of claim 1, wherein the at least one layer of high tensile strength fibrous material is positioned closer to the user than the at least one layer of elastomeric material when the garment is worn by the user.

7. The protective system of claim 1, wherein the plurality of openings extend completely through the padding layer.

8. The protective system of claim 1, wherein the plurality of openings are formed in one or more lines along the surface of the padding layer.

9. The protective system of claim 1, wherein the openings are formed by slots in the padding layer.

10. The protective system of claim 1, wherein the plurality of openings comprise pairs of openings with a strip of material of the padding layer therebetween.

11. The protective system of claim 1, wherein ends of the load bars are received in the respective ones of the plurality of openings.

12. The protective system of claim 1, wherein the load bars comprise a material that is more rigid than a material of the padding layer.

13. The protective system of claim 1, wherein the plurality of load bars are oriented in parallel along the surface of the padding layer.

14. The protective system of claim 1, wherein the plurality of load bars are removable from the respective ones of the plurality of openings by sliding the one or more load bars through the respective ones of the plurality of openings.

* * * * *